US006672958B2

(12) United States Patent
Bennett

(10) Patent No.: US 6,672,958 B2
(45) Date of Patent: Jan. 6, 2004

(54) MULTI-DRAW POKER GAME

(75) Inventor: Nicholas Luke Bennett, Lane Cove (AU)

(73) Assignee: Aristocrat Technologies Australia PTY LTD, Lane Cove (AU)

( * ) Notice: Subject to any disclaimer, the term of this patent is extended or adjusted under 35 U.S.C. 154(b) by 0 days.

(21) Appl. No.: 10/029,768

(22) Filed: Oct. 18, 2001

(65) Prior Publication Data

US 2003/0078092 A1 Apr. 24, 2003

(51) Int. Cl.[7] ..... A63F 1/00; A63F 9/22

(52) U.S. Cl. ..... 463/13; 463/16; 273/292; 273/139; 273/303

(58) Field of Search ..... 463/16, 9, 12, 463/13, 23; 273/292, 138.1, 139, 303, 304

(56) References Cited

U.S. PATENT DOCUMENTS

| | | | | | |
|---|---|---|---|---|---|
| 1,681,683 | A | * | 8/1928 | Ramer | 273/304 |
| 5,042,818 | A | * | 8/1991 | Weingardt | 463/13 |
| 5,732,950 | A | * | 3/1998 | Moody | 273/292 |
| 5,803,809 | A | * | 9/1998 | Yoseloff | 463/13 |
| 5,816,915 | A | * | 10/1998 | Kadlic | 463/13 |
| 5,816,916 | A | * | 10/1998 | Moody | 463/13 |
| 5,823,873 | A | * | 10/1998 | Moody | 463/13 |
| 5,868,619 | A | * | 2/1999 | Wood et al. | 463/13 |
| 5,971,849 | A | * | 10/1999 | Falciglia | 463/16 |
| 6,007,066 | A | * | 12/1999 | Moody | 273/292 |
| 6,050,568 | A | * | 4/2000 | Hachquet | 273/292 |
| 6,098,985 | A | * | 8/2000 | Moody | 273/292 |
| 6,135,883 | A | * | 10/2000 | Hachquet | 463/13 |
| 6,270,405 | B1 | * | 8/2001 | Ferguson | 463/13 |
| 6,334,613 | B1 | * | 1/2002 | Yoseloff | 273/292 |
| 6,435,509 | B2 | * | 8/2002 | Wichinsky et al. | 273/292 |
| 6,474,645 | B2 | * | 11/2002 | Tarantino | 273/274 |

FOREIGN PATENT DOCUMENTS

AU B-45197/97 1/1998

OTHER PUBLICATIONS

Australian Patent Office Patent Application No. AU200138911 A1; Publication Date Nov. 8, 2001.

* cited by examiner

*Primary Examiner*—Jessica Harrison
*Assistant Examiner*—Alex F. R. P. Rada, II
(74) *Attorney, Agent, or Firm*—Knobbe, Martens, Olson & Bear, LLP

(57) ABSTRACT

A poker style card game suitable for playing on a gaming machine. In the game an initial hand of cards is dealt and the player selects particular cards to be held in the hand. The game is characterised in that multiple new hands of held cards are then created wherein the held cards in each new hand are dependent on the held cards in the initial hand but are not identical to the held cards from the initial hand. Additional cards are then drawn to complete each of the hands, and prizes are paid for each hand according to a pay table.

22 Claims, 10 Drawing Sheets

MULTI-DRAW POKER GAME

BACKGROUND OF THE INVENTION

The present invention relates to a multi-draw poker game and in particular to a multi-draw poker game for implementation on gaming machines, also referred to as slot machines, "pokies", and one arm bandits.

DESCRIPTION OF THE PRIOR ART

Players who regularly play gaming machines quickly tire of particular games and it is therefore necessary for manufacturers of gaming machines to come up with either innovative gaming features that add interest to the games provided on such machines, or provide new games in order to keep the players amused and willing to continue playing gaming machines.

The revenue raised by an operator of a particular venue providing gaming machines, depends on the amount of money wagered on the machines. The amount of money wagered on a particular machine is related to the popularity of the machine. Thus, when selecting a supplier of gaming machines, the operator of the venue will pay close attention to the popularity of the various games with their patrons.

Therefore it is important for a gaming machine manufacturers to devise games which are popular with players. Games which are popular with players are often those which are new and therefore gaming machine manufacturers seek to devise new games or game features which have not previously been seen on slot machines, in order to stimulate player interest.

The applicant's own Australian Patent Registration No 690499 discusses an improved multi-draw poker game in which a player can make multiple draws against held cards from a single hand. The present invention seeks to further improve on AU 690499 end provide more interesting variations of poker games.

SUMMARY OF THE INVENTION

In a broadest aspect, the present invention provides a game for playing on a gaming machine or the like wherein one or more indicia are caused to be displayed on a display means and, if a predefined winning event arises a prize is awarded, the game being characterised in that an initial set of indicia is displayed on the display means sad the player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia.

The invention also provides a gaming apparatus or machine incorporating a display means and game control means arranged to control images displayed on the display means arranged to play the game of the present invention.

Thus in that aspect the present invention provides gaming machine having a display means and a game control means arranged to control images displayed on the display means, the game control means being arranged to play a game wherein one or more indicia are caused to be displayed on the display means and, if a predefined winning event arises the machine awards a prize, the gaming machine being characterised in that an initial set of indicia is displayed on the display means and the player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia.

The game might also be played on distributed gaming systems such as Internet based gaming systems and other systems where the game display is remote from the game control system.

One embodiment of the game is implemented as a poker style game using hands "drawn" from decks of standard cards or at least a simulation thereof. In one version of that embodiment the cards in the multiple new hands have the same face value as the held cards but are in different suits. Preferably the "deck of cards includes an additional suit of multi-suit cards which have a single face value e.g. 1 or 2 or 3 etc or Ace etc, but can be any of the four suits. Reference is made to the Applicant's co-pending U.S. application Ser. No. 09/848,188 entitled "IMPROVED CARD GAME" and filed May 2, 2001, the contents of which are incorporated herein by reference.

In an alternative embodiment, the game control means generates multiple new hands of held cards to the same strategy as the originally held cards. The new hands may be dealt with a different face value, or in a different suit.

By "same strategy" is meant that the extra hands of "held" cards reproduce the strategy adopted by the player. For example, if the player is going for an "of-a-kind" hand, four additional of-a-kind hands having the same number of cards are displayed.

In one preferred embodiment, if the already winning hand is a flush, the same cards, if all cards are held by the player (who may wish to discard some of the cards to attempt to obtain a better hand, say a straight flush) are reproduced in the four different suits. If the already winning hand is a straight, the control means generates straights having differing start cards.

However, the "same strategy" embodiment may be used if the first dealt hand is not a winning hand, for example, if three cards having the same suit are dealt and the player holds for a flush.

The holds may be chosen by a player or at the suggestion of the machine on auto hold, although auto hold may be overridden by a player.

BRIEF DESCRIPTION OF THE DRAWINGS

A specific embodiment of the invention will now be described by way of example only, and with reference to the accompanying drawings in which.

DETAILED DESCRIPTION OF PREFERRED EMBODIMENTS

In the following detailed description, the methodology of the embodiments will be described and it is to be understood that it is within the capabilities of the non-inventive worker in the art to introduce the methodology on any standard microprocessor based gaming machine by means of appropriate programming.

AU 690499 discloses novel arrangements for sequential or simultaneously wagering on several hands dealt in one poker game played on a gaming machine. This is achieved by allowing a player multiple parallel draws to replace cards discarded from a randomly chosen hand. The present invention is an improvement over AU 690499 and is designed to produce more variation in the game and increase player interest.

Figure 13:
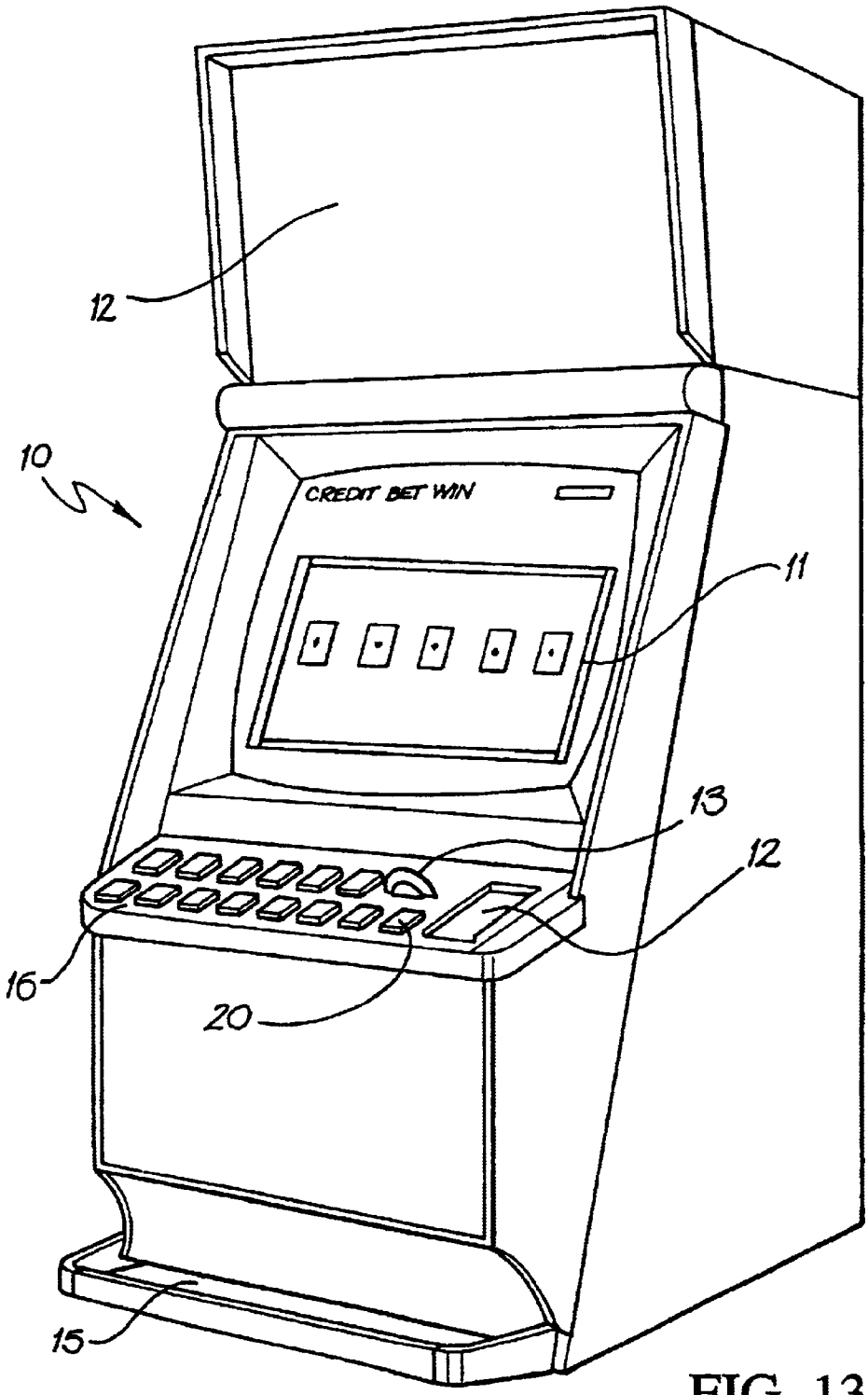
FIG. 13 illustrates a gaming machine.

Referring to FIG. 13, the illustrated embodiment of the invention is housed in a conventional gaming machine cabinet 10 including a game display means or screen 11, prize display 12, a coin entry slot 13, a bill entry slot 14, a payout tray 15, a midtrim 16 on which there is an array of buttons, and internally mounted game processor circuits.

Typically, the game display means comprises a video display screen 11 controlled to display images of the cards dealt in each hand. The video screen is preferably of the touch sensitive variety, having an array of touch sensitive areas located on its display surface.

Player controls are implemented by pressing buttons on the midtrim 16.

One such control is a play button 20, which, when pressed causes a game to be initiated. Buttons are also provided to enable bets of a particular number of credits to placed on the hand. The player may have to nominate in advance, the number of hands that they wish to play (from 1 to 5). Of course, although these buttons are provided as physical buttons in the described embodiment, they could also be provided as virtual buttons on the display screen of the machine, or as a mixture of physical or virtual buttons, The first embodiment uses a deck comprising a standard fifty-two-card deck which has at least one joker and thirteen multi-suit cards added to it. Typically, a separate deck will be used for each hand and all cards for each hand are drawn from the same deck, although it would be possible to use a single deck. A multi-suit card is a card having a particular single value from one to Ace, which can be any one of the four suits, diamond, clubs, hearts, and spades. Each multi-suit ten is shown in the hand illustrated in FIG. 5. Reference is made to U.S. Ser. No. 09/848,188 referred to above for full description of multi-card suits.

Figure 1:
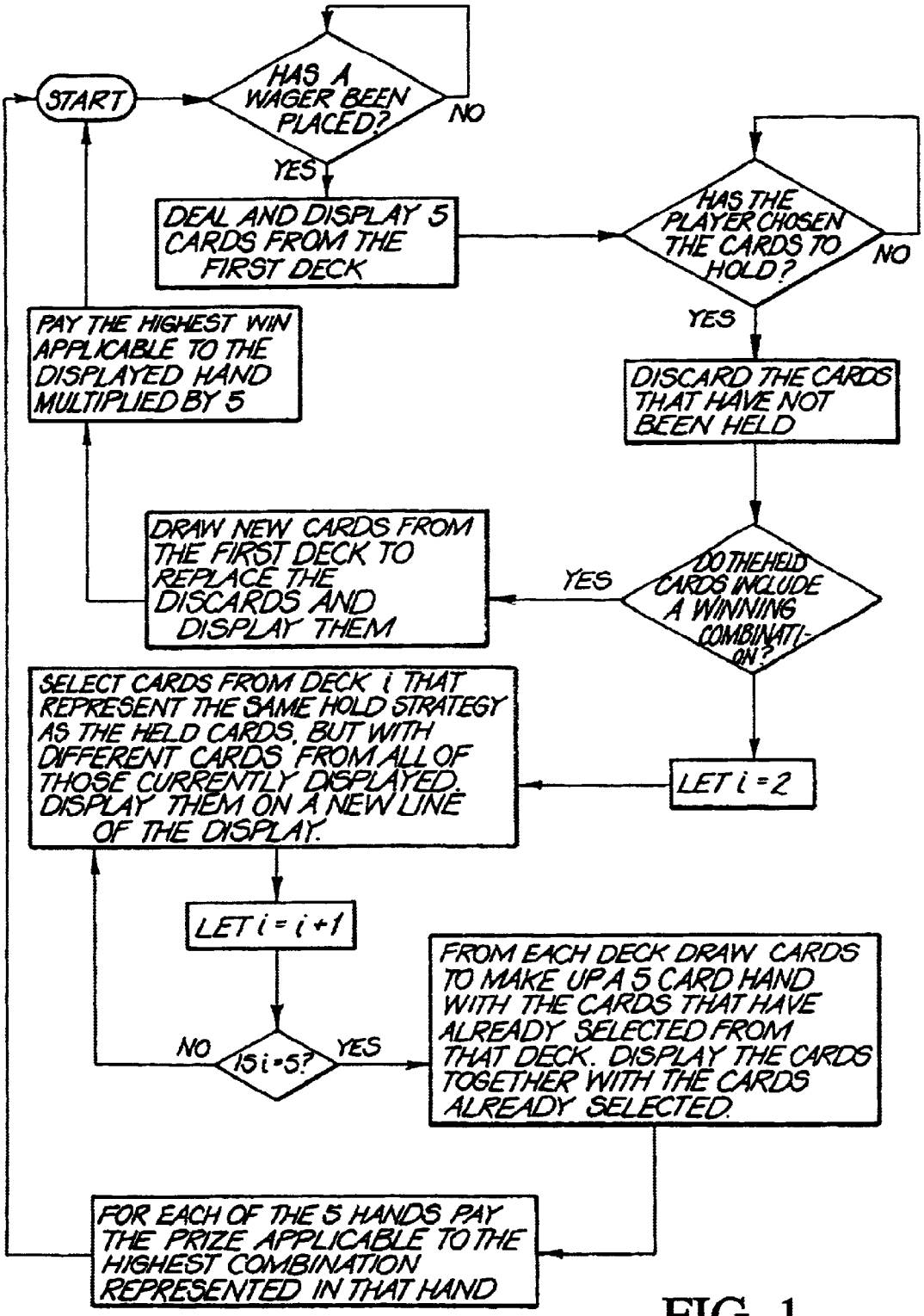
FIG. 1 is a simplified flow chart for a first embodiment of the present invention.

FIG. 1 illustrates a simplified procedure for the game in a flow chart.

The playing of two exemplary games according to the method, will now be described as follows.

EXAMPLE 1

Figure 2:
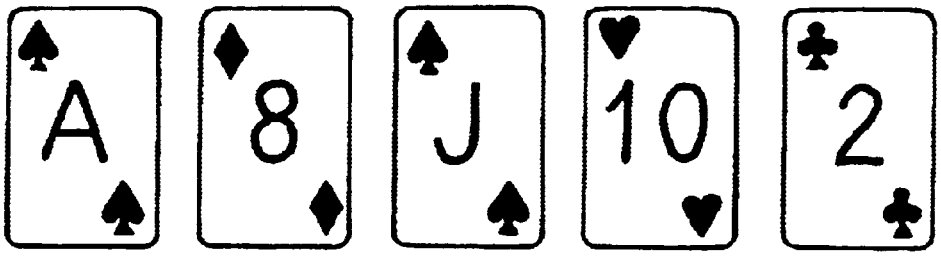
FIG. 2 illustrates an initial hand provided in a first example of a game played according to the first embodiment.
Figure 3:
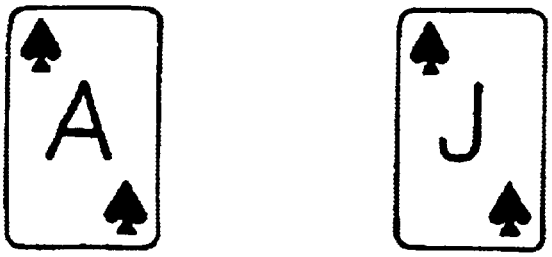
FIG. 3 illustrates the cards which the player chooses to hold in the first example.

The player makes a wager on the gaming machine 10 configured to play the game according to the present invention and presses start 20 and an initial hand is dealt. As shown in FIG. 2, the hand comprises the Ace of Spades, the eight of Diamonds, the Jack of Spades, the ten of Hearts and the two of Clubs. Referring to FIG. 3, the player choses to hold the Ace of Spades, and the Jack of Spades, possibly in the hope of obtaining a Royal Flush. The remaining cards are discarded, and disappear from the display.

Figure 4:
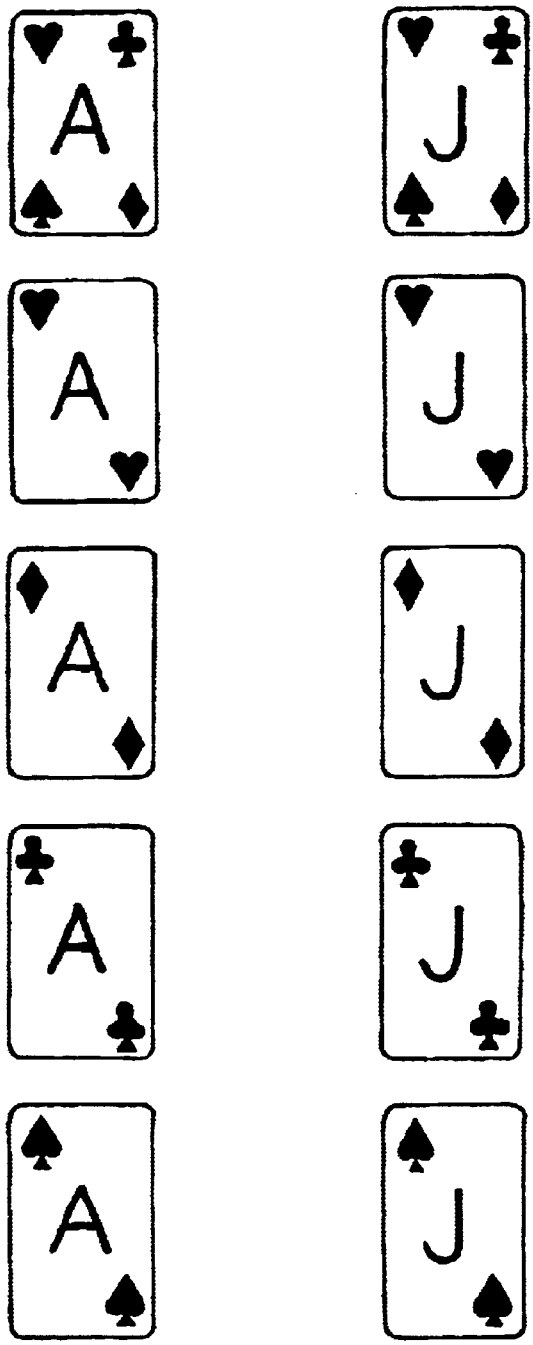
FIG. 4 illustrates the reproduction of the value of the held cards of FIG. 3 into four other suits.

Referring to FIG. 4, according to the first embodiment of the present invention, the same value cards are reproduced in four other hands in the four other suits being the multi-suit and Hearts, Diamonds and Clubs. FIG. 4 shows the display of resultant sets of held cards. The cards in each hand are drawn from the separate deck for that hand. Next, cards are drawn from the five separate decks against each of the five sets of held cards shown in FIG. 4. Prizes are paid according to a standard game pay table depending on the resultant hands produced after the five draws.

EXAMPLE 2

Figure 5:
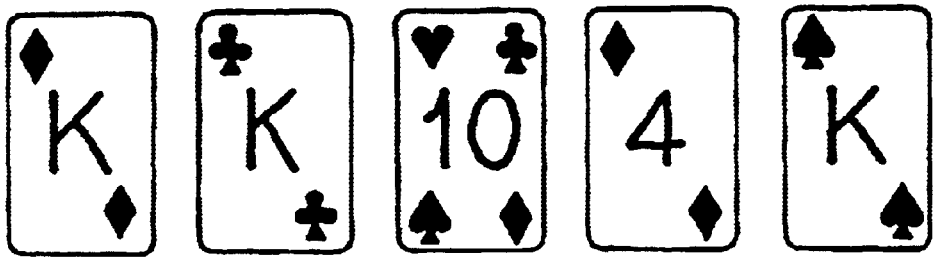
FIG. 5 shows an example of a second hand dealt according to the first embodiment of the present invention.
Figure 6:
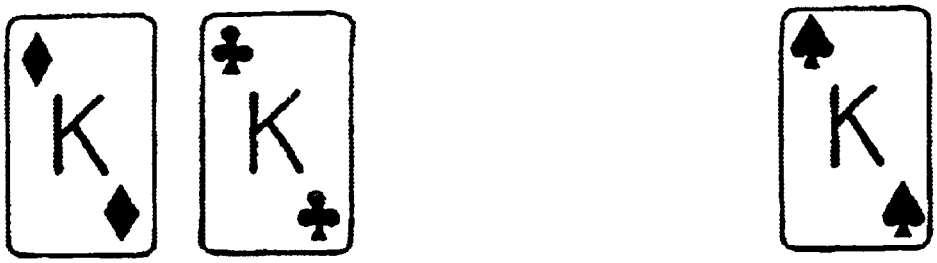
FIG. 6 illustrates the cards held from the second hand.
Figure 7:
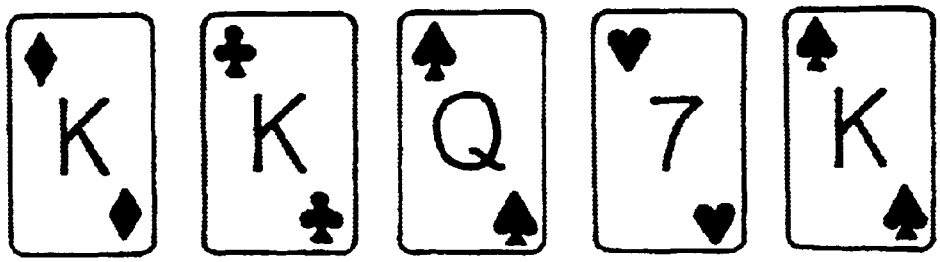
FIG. 7 shows the resulting hand after a draw to the retained cards shown in FIG. 6.

The second example is an example of a hand in which the held cards include a winning combination. FIG. 5 shows the initial hand dealt which includes three Kings, a four of Diamonds, and a multi-suit ten. Referring to FIG. 6, the player holds the three Kings and choses to discard the ten and four which disappear from the display. Because the hand is already a win only one hand is played out and a draw is made to the three Kings. FIG. 7 shows the resultant hand after the draw. Since no improvement occurred, the win is for three Kings, i.e. a three of a kind. The prize awarded will be the standard prize for that combination according to the machine's pay table but multiplied by five. If instead of receiving the Queen and the seven an improvement had occurred and additional one or two Kings had been dealt, (remembering that the deck of cards includes five suits), the prize paid would have been for the improved combination (four or five of a kind) according to the pay table multiplied by five.

A second embodiment of the present invention will now be described.

In this second embodiment the card value is not necessarily reproduced in the addition hands as it is in the first embodiment. Instead, the computer merely reproduces the strategy adopted by the player. Hence, more than five additional different hands can be created without repeating and the additional different hands can be provided regardless of whether the held hands already contain a winning combination or not. For non-winning holds, the second embodiment preferably operates in the same way as the first embodiment. Hence, if the hand shown in FIG. 2 were initially dealt and the player held the cards shown in FIG. 3, in the second embodiment, Example 1 would operate in the same fashion as the first embodiment described above.

Figure 8:
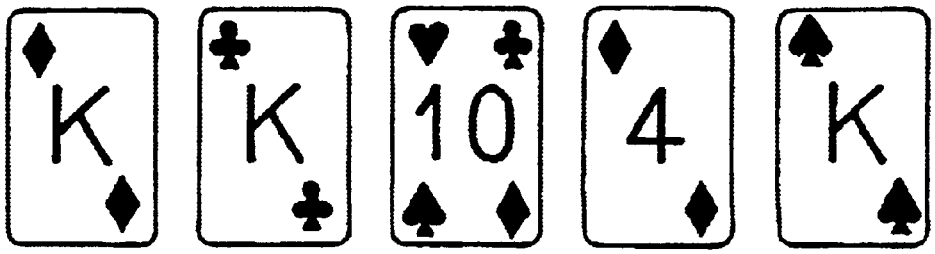
FIG. 8 shows a first hand dealt in a second embodiment of the game of the present invention.
Figure 9:
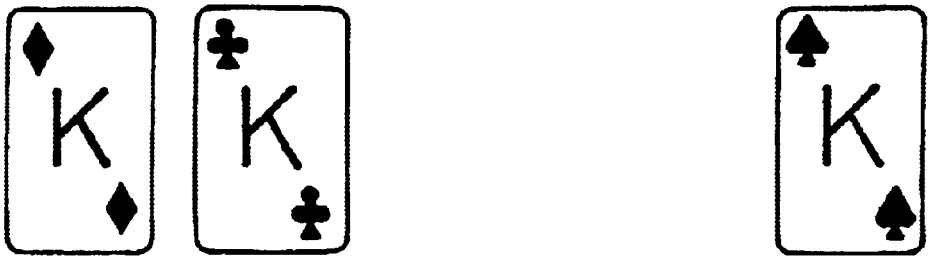
FIG. 9 shows the cards held by the player from the hand shown in FIG. 8.
Figure 10:
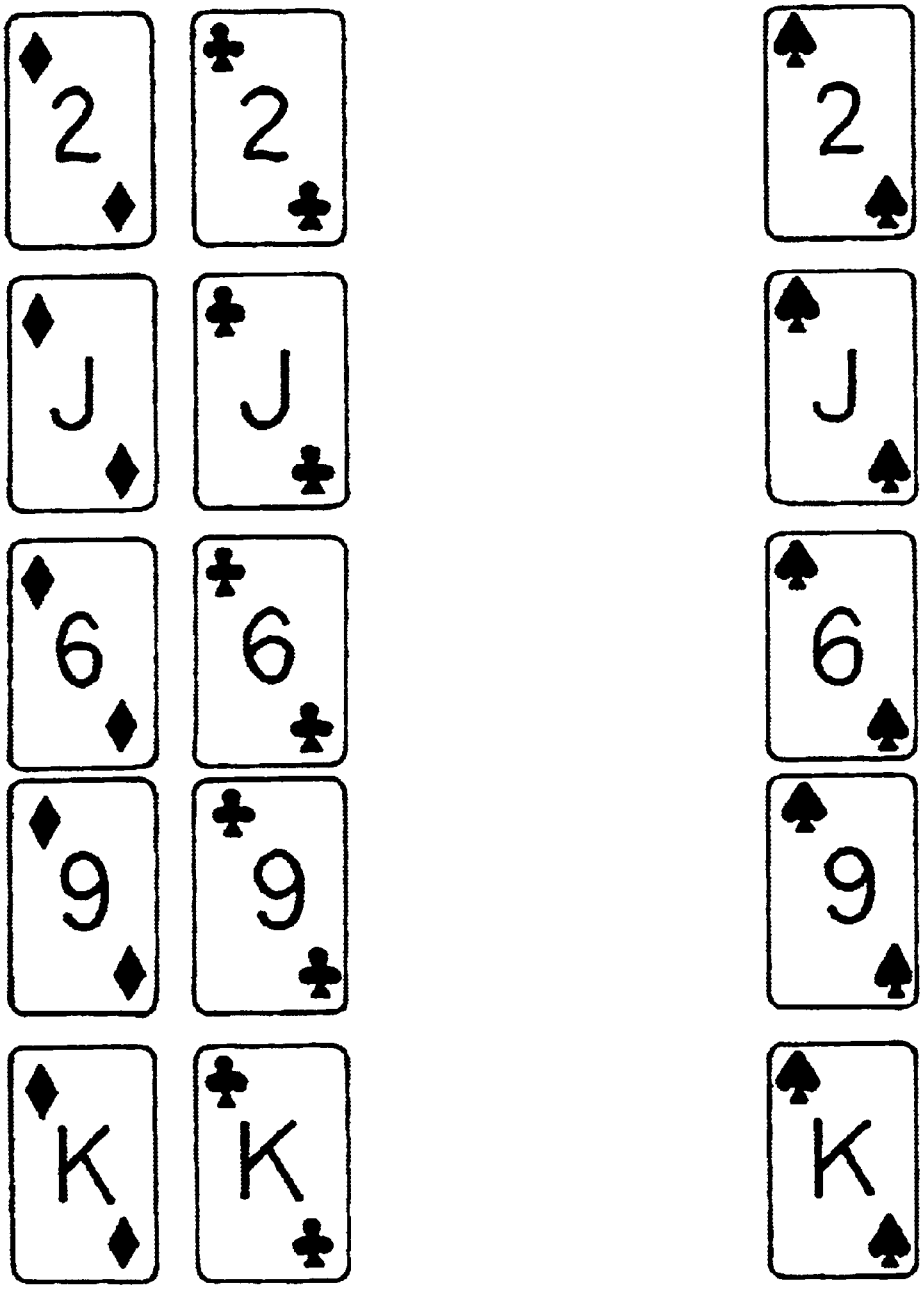
FIG. 10 shows the resultant display of hands on the display means of the gaming machine.

This second embodiment of the game differs when the held hand already contains a winning combination. For example, with reference to FIG. 8, a hand containing a King of Diamonds, King of Clubs, King of Spades, a multi-card ten and a four of Diamonds is dealt. As shown FIG. 9, the player holds the three Kings and discards the other two cards which are removed from the display. Instead of just dealing two additional cards and paying out five times the value of the resultant hand, as would be done in the first embodiment, the same strategy is reproduced in the same suits into four or more hands as shown in FIG. 10 in which the five resultant hands are three twos, three Jacks, three sixes, three nines and three Kings. By "same strategy" is that the extra hands of "held" cards reproduce the strategy adopted by the player. For example, if the player is going for an "of-a-kind" hand, four additional of-a-kind hands having the same number of cards are displayed.

Draws are then made from five separate decks against each of the five sets of three of a kind. Prizes are then paid for each hand depending on the resultant hands after the additional draws. The player is guaranteed to be paid at least five times the prize for a three of a kind combination, but may be paid more if any of the hands result in an improvement to four or five of a kind. The deck does not include a joker.

If the already winning hand is a flush, the same cards are reproduced in the four different suits as in the first embodiment. If the already winning hand is a straight, the control means generates straights having differing start cards. In the pay table, for three or more of a kind the face value of the cards in the "of-a-kind" hand has no bearing on the prize paid. Thus three Kings is no more valuable than three twos. Both hands pay the same amount. Royal straight and flushes may be treated as standard straights/flushes with regard to the reproduction strategy. However royal combinations may still be awarded improved prizes in comparison with non-royal flushes and straights, even if they have been generated due to a reproduction of a non-royal combination.

Figure 11:
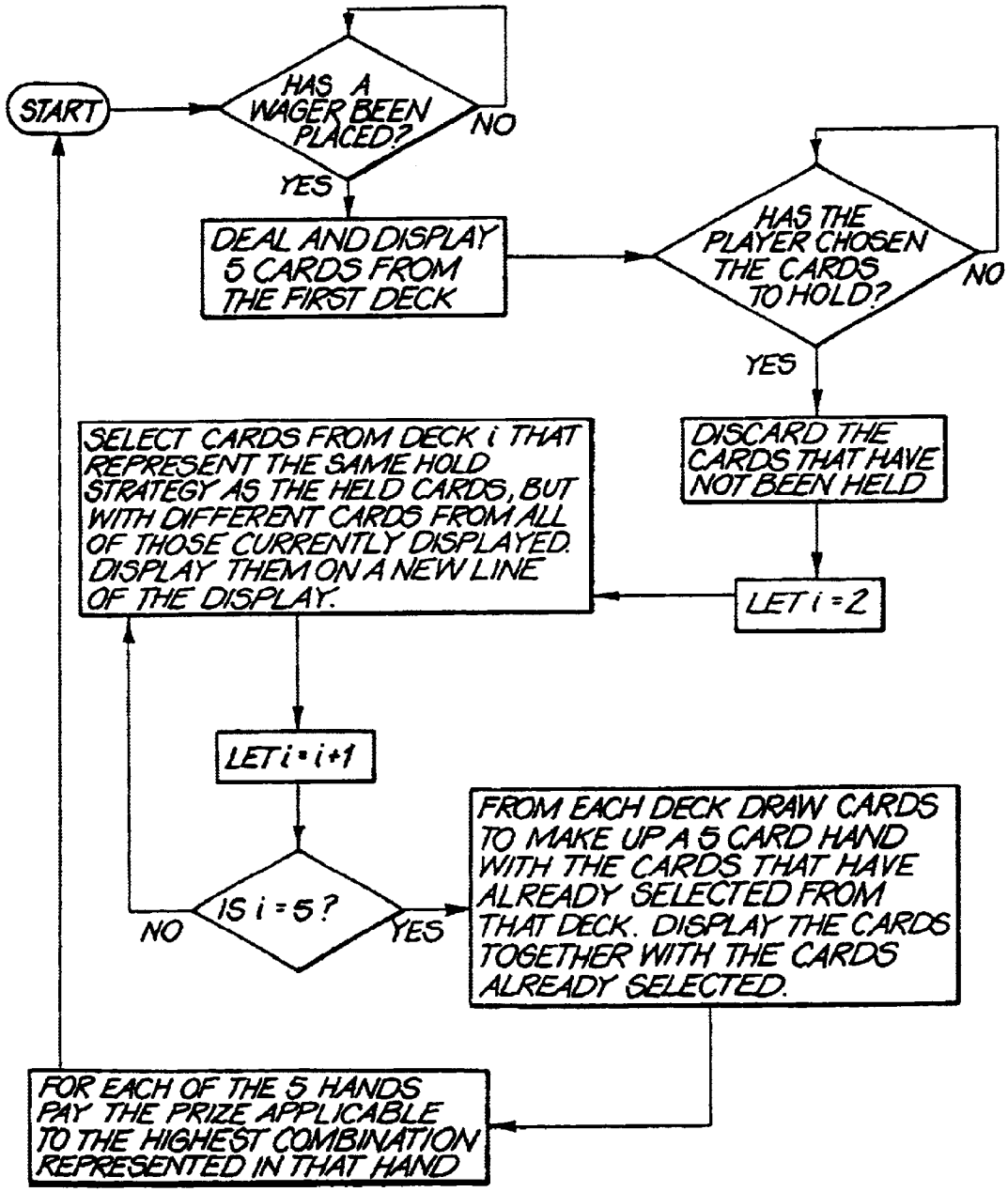
FIG. 11 is a simplified flow chart for the second embodiment.

FIG. 11 illustrates a simple flow chart for the procedure.

The value of the Jack, Queen and King is 11, 12 and 13 and the Ace is either 14 or 1.

Figure 12:
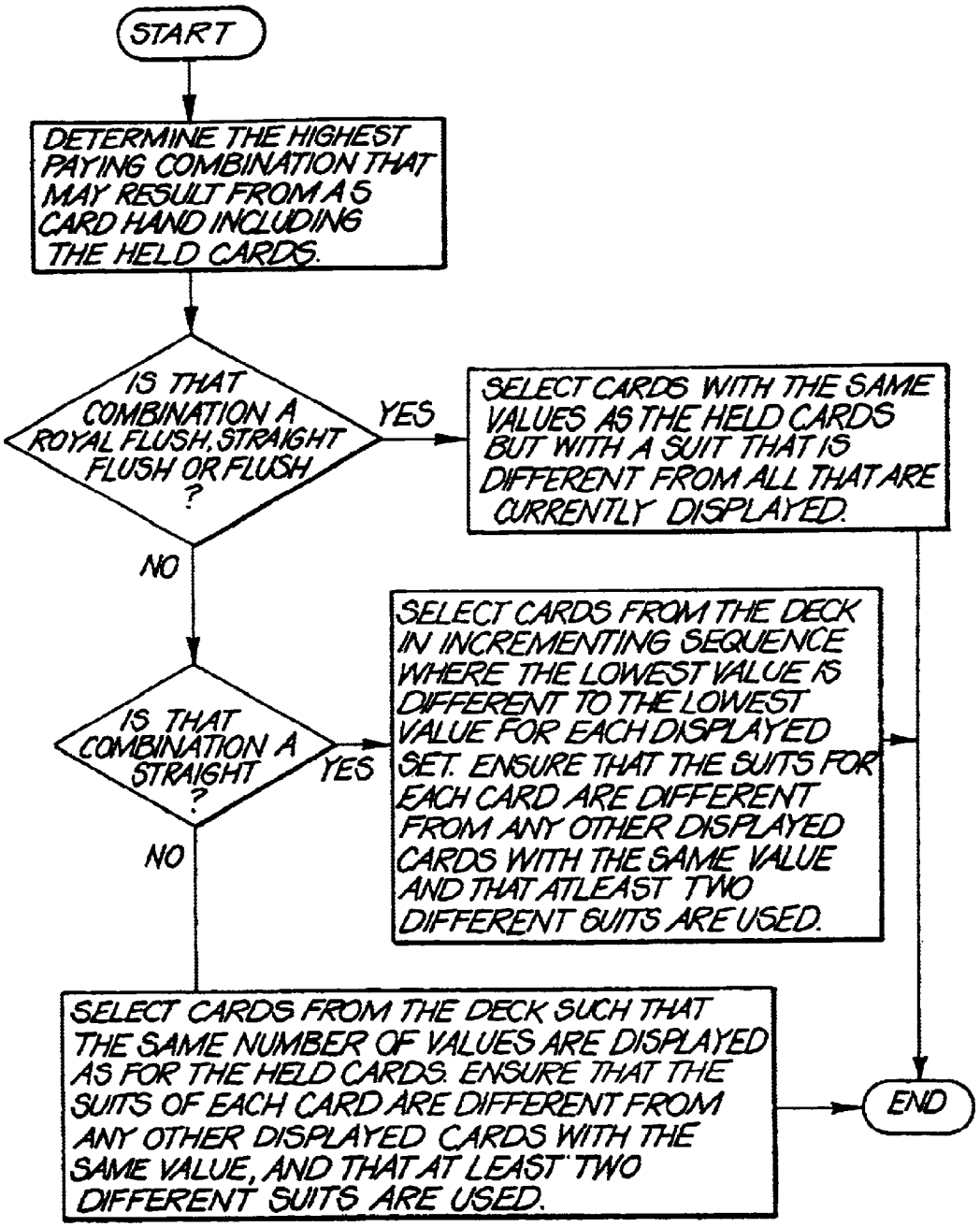
FIG. 12 is a flow chart for the step of reproduction of the same winning combination into four additional hands.

FIG. 12 shows a flow chart of the step of reproducing the same winning combination into four more or hands as shown in FIG. 11.

Figure 14:
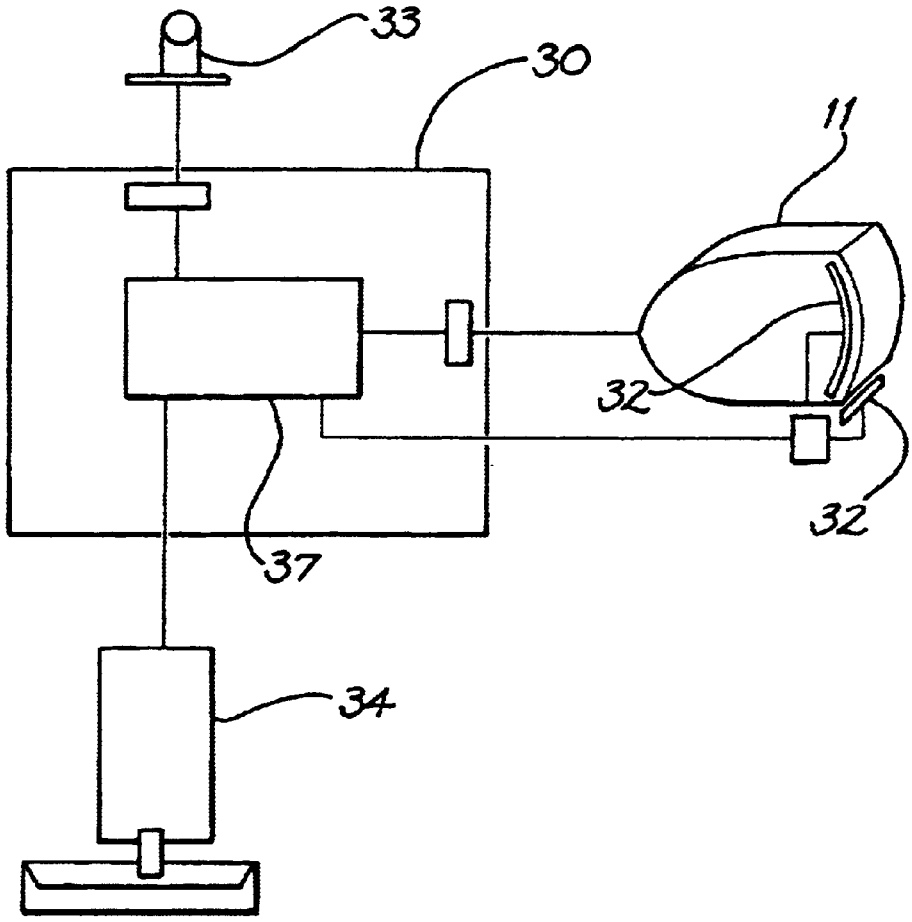
FIG. 14 is a schematic diagram of a gaming machine control circuit.

The program to implement the game runs on a standard gaming machine control processor 31 as illustrated schematically in FIG. 14. This processor forms part of a controller 37 which drives at the display screen 11 and receives touch input signals from touch sensors 32 as well as receiving coin input pulses from a coin chute mechanism 33 and driving a coin payout mechanism 34.

Thus, the present invention provides a game which has all the advantages of AU 690499, but provides a more varied display and more variations to the game play, thus providing increased player interest.

Although the above described embodiment refers to a game of draw poker, it would be appreciated that the invention can be applied to a traditional spinning reel game (fruit machine). A pair of symbols may be held in one row and then pairs of different symbols would be placed in additional rows. There may be different pays for different symbols as, unlike draw poker, in spinning reel games combinations of different symbols pay different prizes. For example, three bells may pay more than three oranges.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine having a display means and a game control means arranged to control images displayed on the display means, the game control means being arranged to play a game wherein one or more indicia are caused to be displayed on the display means and, if a predefined winning event arises the machine awards a prize, the gaming machine being characterised in that an initial set of indicia is displayed on the display means and, the player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia and wherein the game played is a poker style card game, the indicia represent playing cards, and the sets of indicia are hands of the cards and wherein the cards in the one or more additional hands have the same face value as the cards held from the initial hand but are in different suits.

2. A gaming machine as claimed in claim 1 wherein if the initial set of indicia is a winning combination, no additional sets are generated and the prize awarded is a multiple of the prize for one winning combination.

3. A gaming machine as claimed in claim 1 wherein additional indicia are drawn to the indicia held in the initial set and to the additional sets of indicia to generate a plurality of resultant sets, and prizes are paid for each resultant set according to a pay table.

4. A gaming machine as claimed in claim 1 wherein the gaming machine indicates suggested holds for the player from the initial set which holds may be overridden by the player.

5. A gaming machine having a display means and a game control means arranged to control images displayed on the display means, the game control means being arranged to play a game wherein one or more indicia are caused to be displayed on the display means and, if a predefined winning event arises the machine awards a prize, the gaming machine being characterised in that an initial set of indicia is displayed on the display means and, the player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia and wherein the game played is a poker style card game, the indicia represent playing cards, and the sets of indicia are hands of the cards wherein the cards are dealt from a deck which includes a suit of multi-suit cards each card of which has a single face value but which may be in two or more of the four suits.

6. A gaming machine as claimed in claim 5 wherein following the selection of the held cards the game control means generates multiple new hands of held cards to the same player strategy as the initially held cards.

7. A gaming machine as claimed in claim 6 wherein the additional hands are dealt with a different face value to that of the initially held cards.

8. A gaming machine as claimed in claim 7 wherein the additional hands are dealt in a different suit to that of the initially held cards.

9. A gaming machine as claimed in claim 8 wherein if the player strategy is to retain two or more cards of the same face value, four additional hands, each hand having the same number of cards of the same face value, are displayed.

10. A gaming machine as claimed in claim 6 wherein if the player holds multiple face value cards of the same suit from the initial hand, the same face value cards are reproduced in different suits to the initially dealt hand in the multiple new hands.

11. A gaming machine as claimed in claim 6 wherein if the player holds multiple cards in a sequence in which adjacent cards increase in consecutive denominations, the control means generates additional hands of cards in sequences in which adjacent cards increase in consecutive denominations but having differing start cards.

12. A game for playing on a gaming apparatus wherein one or more indicia are caused to be displayed on a display means and, if a predefined winning event arises a prize is awarded, the game being characterised in that an initial set of indicia is displayed on the display means and a player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia wherein the game played is a poker style card game, the indicia represent playing cards, and the sets of indicia are hands of the cards and wherein the cards in the one or more additional hands have the same faces value as the cards held from the initial hand but are in different suits.

13. A game for playing on a gaming apparatus as claimed in claim 12 wherein if the initial set of indicia is a winning combination, no additional sets are generated and the prize awarded is a multiple of the prize for one winning combination.

14. A game for playing on a gaming apparatus as claimed in claim 12 wherein additional indicia are drawn to the indicia held in the initial set and to the additional sets of indicia to generate a plurality of resultant sets, and prizes are paid for each resultant set according to a pay table.

15. A game for playing on a gaming apparatus as claimed in claim 12 wherein the of cards are dealt from a deck which includes a suit of multi-suit cards each card of which has a single face value but which may be in two or more of the four suits.

16. A game for playing on a gaming apparatus as claimed claim 15 wherein following the selection of the held cards the game control means generates multiple new hands of held cards to the same player strategy as the initially held cards.

17. A game for playing on a gaming apparatus as claimed claim 16 wherein the additional hands are dealt with a different face value to that of the initially held cards.

18. A game for playing on a gaming apparatus as claimed in claim 17 wherein the additional hands are dealt in a different suit to that of the initially held cards.

19. A game for playing on a gaming apparatus as claimed in claim 18 wherein if the player strategy is to retain two or more cards of the same face value, four additional hands, each hand having the same number of cards of the same face value are displayed.

20. A game for playing on a gaming apparatus as claimed in claim 15 wherein if the player holds multiple cards of the same suit from the initial hand, the same cards are reproduced in different suits to the initially dealt hand.

21. A game for playing on a gaming machine as claimed in claim 12 wherein the gaming machine indicates suggested holds for the player from the initial set which holds may be overridden by the player.

22. A game for playing on a gaming apparatus wherein one or more indicia are caused to be displayed on a display means and, if a predefined winning event arises a prize is awarded, the game being characterised in that an initial set of indicia is displayed on the display means and a player selects one or more indicia to be held from that initial set, other non-held indicia being discarded from the set and wherein following the player selection, one or more additional sets of indicia are then generated and displayed on the display means and wherein the indicia in each additional set are dependent on the indicia held in the initial set but are not identical to those held indicia wherein the game played is a poker style card game, the indicia represent playing cards, and the sets of indicia are hands of the cards and wherein if the player is initially dealt a complete winning hand in the form of a straight, the control means generates additional straights having differing start cards.

* * * * *

UNITED STATES PATENT AND TRADEMARK OFFICE

CERTIFICATE OF CORRECTION

PATENT NO. : 6,672,958 B2
DATED : January 6, 2004
INVENTOR(S) : Nicholas L. Bennett It is certified that error appears in the above-identified patent and that said Letters Patent is hereby corrected as shown below:

Column 7,
Line 33, after "the" delete "of".
Line 37, after "claimed" insert -- in --.

Column 8,
Line 1, after "claimed" insert -- in --.

Signed and Sealed this

Twenty-first Day of March, 2006

JON W. DUDAS
*Director of the United States Patent and Trademark Office*